United States Patent [19]

Doucet

[11] 4,044,666

[45] Aug. 30, 1977

[54] ATTACHMENT FOR OFFSET DUPLICATING MACHINE

[76] Inventor: Laurent Doucet, 13, l'Assomption, Repentigny, Quebec, Canada

[21] Appl. No.: 670,050

[22] Filed: Mar. 24, 1976

[51] Int. Cl.[2] ..... B41L 45/00

[52] U.S. Cl. ..... 101/76; 101/247; 101/77

[58] Field of Search ..... 101/70, 72, 76–77, 101/84–89, 113, 132.5, 218, 247

[56] References Cited

U.S. PATENT DOCUMENTS

| | | | |
|---|---|---|---|
| 1,920,232 | 8/1933 | Allen | 101/77 |
| 2,683,409 | 7/1954 | Dutro et al. | 101/77 |
| 2,839,991 | 6/1958 | Rotloff | 101/77 |
| 2,874,636 | 2/1959 | Royer et al. | 101/218 |
| 3,046,877 | 7/1962 | Janke | 101/76 |
| 3,598,044 | 8/1971 | Hutchinson | 101/76 |
| 3,611,921 | 10/1971 | Jahn | 101/77 |
| 3,728,960 | 4/1973 | Heath | 101/76 |
| 3,782,277 | 1/1974 | Neal | 101/76 |

*Primary Examiner*—Edward M. Corer
*Attorney, Agent, or Firm*—Burgess, Ryan and Wayne

[57] ABSTRACT

The attachment device is adapted to be mounted to the delivery end of an offset duplicating machine and includes: a frame; an impression cylinder rotatably mounted to the sidewalls of the frame; a gripper bar device which is also rotatably mounted to the sidewalls of the frame and which is disposed between the duplicating machine and the impression cylinder, the gripper bar device including a gear wheel in meshing engagement with a gear wheel of the duplicating machine and with a gear wheel on the impression cylinder, the gripper bar device further including a series of members for gripping a sheet received from the duplicating machine and for conveying it to gripping elements on the impression cylinder; and character printing means mounted to the frame, including a gear wheel in meshing engagement with the gear wheel of the impression cylinder and a character numbering device rotatably mounted to contact successive sheets conveyed on the impression cylinder so as to print consecutive characters thereon. Means are also provided to avoid the printing of a character and the changing of a character should there be a void in the successive feeding of sheets in the attachment.

12 Claims, 8 Drawing Figures

ATTACHMENT FOR OFFSET DUPLICATING MACHINE

FIELD OF THE INVENTION

The present invention relates generally to duplicating machines and, more particularly, to an attachment device for use with an offset printing machine for consecutively imprinting a code character on successive sheets being delivered therefrom.

BACKGROUND OF THE INVENTION

Present offset printing machines have two different types of delivery. In one case, the printed sheets are guided and dropped in a receiving shelf adjacent the delivery end of the machine. In the other case, a cylinder disposed adjacent the delivery end and equipped with sheet gripping members transfers each sheet to a series of similar grippig elements which are mounted on chains and carry the sheets to a tray located at some distance from the machine.

In number of cases, such as for invoice sheet printing, it is necessary to imprint consecutive numbers on successive sheets being fed through the duplicating machine. At present, there does not exist a separate attachment device which may be added to already existing machines so that the sheets may be numbered consecutively. Distinct numbering devices are built for each type of duplicating machines. On duplicating machines having a chain type delivery, the numbering device is located in the chain delivery attachment itself; hence, should repair or change of the numbering device be required, the whole chain delivery attachment must be removed and replaced. On the other type of offset machine, the numbering device is built in the machine and, should repair or replacement be required, the printing machine cannot even be used for normal printing.

OBJECTS OF THE INVENTION

It is an object of the present invention to provide, on an offset duplicating machine, either of the direct ejecting type or of the chain-delivery type, an attachment device which allows consecutive numbering on the successive sheets delivered from the machine.

It is another object of this invention to provide a numbering attachment which may be easily and rapidly assembled of disassembled from existing offset duplicating machines.

It is a further object of this invention to provide such numbering attachment with means which will prevent the numbering of the sheets and a number change should there be a void in the successive feeding of sheets.

STATEMENT OF THE INVENTION

The present invention therefore relates, in its broadest aspect, to an attachment device for use with an offset duplicating machine having, at the delivery end thereof, rotary cylinder means including a circular gear means and sheet gripping means for conveying a sheet to the delivery end of the machine, the attachment being provided for imprinting consecutive code characters on successive sheets delivered from the duplicating machine, and comprising, in combination: a frame consisting of laterally spaced sidewalls fixedly mounted to the delivery end of the duplicating machine; an impression cylinder rotatably mounted, at opposite ends thereof, to the delivery end of the duplicating machine; an impression cylinder rotatably mounted, at opposite ends thereof, to the sidewalls of the frame and including circular gear means and sheet gripping means; a gripper bar device rotatably mounted to the sidewalls of the frame and being disposed between the rotary cylinder means of the machine and the impression cylinder; the gripper bar device including circular gear means in meshing engagement with the circular gear means of the rotary cylinder means and with the gear circular gear means of the impression cylinder, and further including a series of sheet gripping elements for gripping a sheet received from the rotary cylinder means and for conveying the sheet to the gripping means of the impression cylinder; and character printing means mounted to the sidewalls of the frame, including: rotatable shaft, circular means on said shaft in meshing engagement with the impression cylinder, and an actuatable character containing device mounted on the shaft and adapted to successively contact the sheets, when conveyed on the impression cylinder, for printing consecutive characters thereon.

In the preferred form of the invention, means are provided for preventing the printing of a character and a change of character should there be no sheet passing in the attachment.

Other objects and further scope of applicability of the present invention will become apparent from the detailed description given hereinafter; it should be understood, however, that the detailed description, while indicating preferred embodiments of the invention, is given by way of illustration only since various changes and modifications within the spirit and scope of the invention will become apparent to those skilled in the art from this detailed description.

BRIEF DESCRIPTION OF THE DRAWINGS

FIG. 1, is an enlarged perspective partial view showing the eccentric shaft of the impression cylinder of the attachment device; FIG. 2, is a perspective partial view showing the operation of sheet gripping members.

DESCRIPTION OF PREFERRED EMBODIMENTS

The construction and operation of offset duplicating machines are well known and a detailed description thereof is not deemed necessary for a complete understanding of the present invention. It must be said, however, that there are usually two types of delivery end on these machines: a first type consists in letting the printed sheets simply drop under the action of gravity in a receiving shelf (usually, in this type of delivery, the sheets are guided to the shelf by roller equipped pivotable arms); in the other type of delivery, a series of chain connected gripping members carry the sheets from the duplicating machine to subsequently drop them in a receiving shelf. The latter type of delivery is the one illustrated in the attached drawings.

Figure 1:
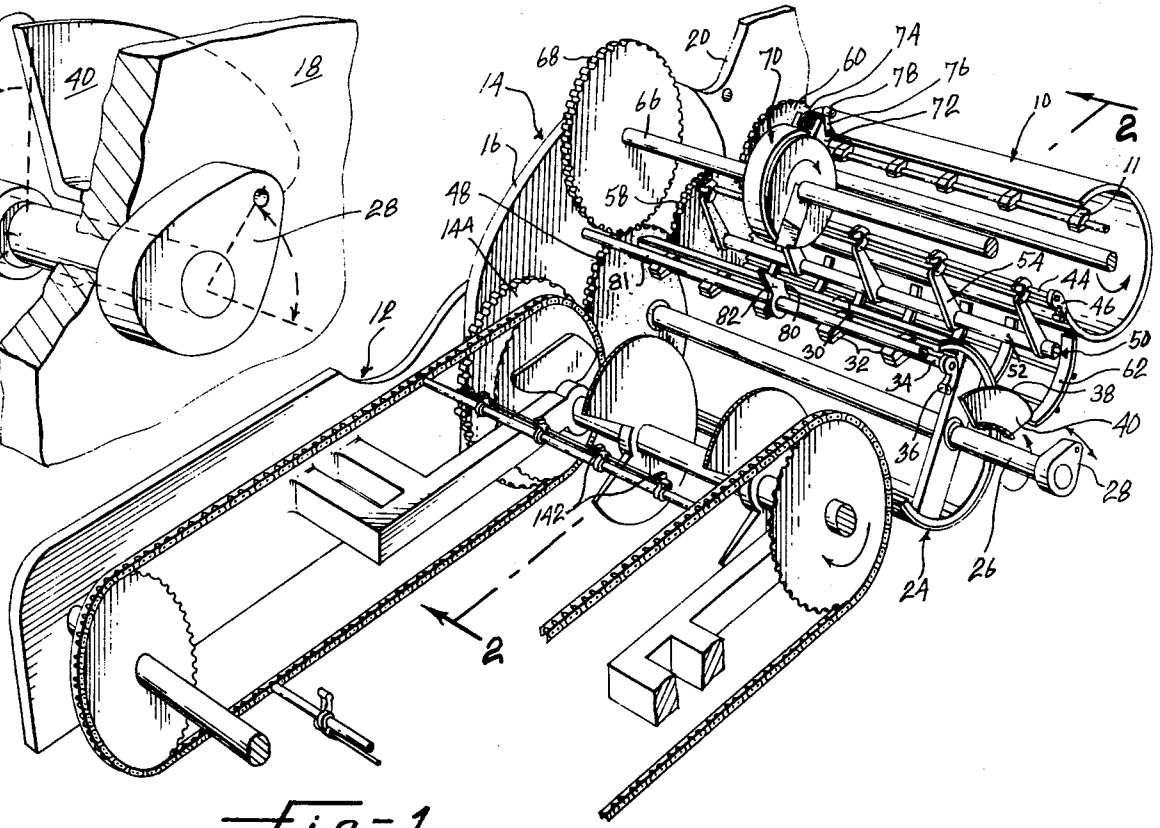
FIG. 1 is a perspective partial view of an attachment device made in accordance with the present invention, shown mounted between the delivery end of an offset duplicating machine and a chain-delivery attachment for such machine.
Figure 2:
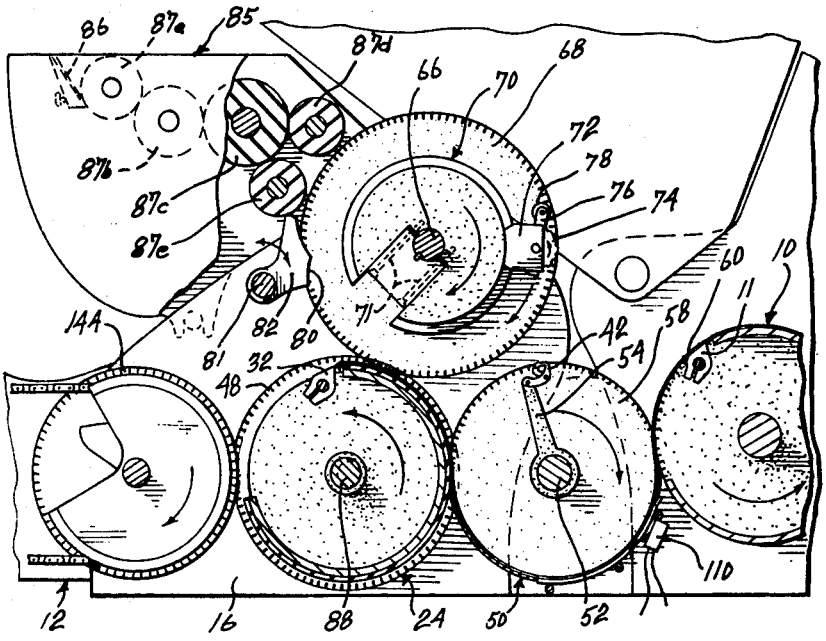
FIG. 2 is a cross-sectional view taken along lines 2—2 of FIg. 1.

Referring to FIGS. 1 and 2, there is shown an impression rotary cylinder 10 which is the one usually found mounted at the delivery end of an offset duplicating machine (not shown), and a chain delivery device 12 which is usually directly mounted to the delivery end of the printing machine adjacent the impression cylinder 10.

The present invention concerns an attachment device 14 to be mounted between the impression cylinder 10 of the printing machine and the chain delivery device 12. This attachment serves to imprint consecutive code characters to successive sheets which exit the duplicating machine. For the remaining portion of this description, these code characters will be referred as numbers; however, it should be understood that other types of code could be used, such as letters.

The attachment device 14 comprises parallel laterally spaced side walls, generally denoted as 16 and 18, fixedly mounted to corresponding end walls 20 and 22 of the offset duplicating machine. An impression cylinder 24 is mounted on a shaft 26 having its opposite ends rotatably supported in sidewalls 16 and 18. A member having a lever portion 28 is fixedly mounted to one end of shaft 26 outside wall 18; its function and operation will be described below.

The impression cylinder 24 is similar in construction to the impression cylinder 10 found in most conventional offset machines; it includes an incomplete cylindrical surface 30 having a gap in which are received a series of sheet gripper members 32 mounted on a rod 34. The construction of these gripping members is well known and their actuation is caused by the pivotal action of levers 36 mounted to rod 34 rolling along surface 38 of a cam plate 40 secured to the inner face of side wall 18. The impression cylinder 24 includes, at one end thereof, a gear wheel 48.

Figure 8:
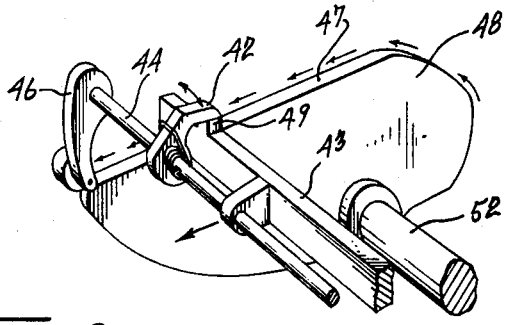
FIG. 8, which is shown on the sheet showing

A gripper bar device 50 is mounted between impression cylinder 10 and impression cylinder 24; it includes a shaft 52 rotatably mounted, at opposite ends thereof, to sidwalls 16 and 18 and a series of laterally spaced arms 54, mounted on shaft 52, and each provided, at their free end, with sheet gripping means. One example of such means will now be given with reference to FIG. 8. It consists of a spring-biased finger 42 mounted on a finger-interconnecting rod 44; a small lever 46, fixed at one end of rod 44, causes the pivotal movement of the rod as it rolls along the surface 47 of cam plate 48 fixed to the inner face of sidewall 18. A sheet is gripped by being held between fingers 42 and a series of raised portions 49 on a bar 43 to which is also mounted rod 44. The gripper bar device 50 further includes a gear wheel 58 in meshing engagement with gear 48 of the impression cylinder 24 and with a gear wheel 60 provided on the impression cylinder 10.

Beneath the gripper bar device 50, there is provided a sheet guiding structure 62 defining an arc-shaped segment. This structure guides the movement of the sheet as it passes from the impression cylinder 10 to the bar device 50.

The attachment further comprises character printing means that include a shaft 66 rotatably supported, at opposite ends thereof, to sidwalls 16 and 18, and a gear wheel 68 mounted on one end of shaft 66 and in meshing engagment with gear wheel 48 of the impression cylinder 24. These printing means further include a character containing device or numbering device 70, which is equipped with releasable fastening means 71 for permitting device 70 to take various positions along shaft 66. This numbering device 70 includes a small housing 72 in which is mounted a series of number wheels 74; rotation of these wheels 74 for consecutive numbering is effected by the actuation of an arm 76 equipped with a roller 78. Arm 76 is actuated when roller 78 contacts surface 80 of a lever member 82 fixedly mounted on a rod 81, which, in turn, is rotatably supported on sidewalls 16 and 18.

Referring to FIG. 2, the character printing means further comprise an ink dispensing device 85 that includes an ink retaining pan 86 and a series of ink transfer rollers 87*a*, 87*b*, 87*c*, 87*d* and 87*e*, the last two being in close proximity with the path of the number wheels 74.

Figure 7:
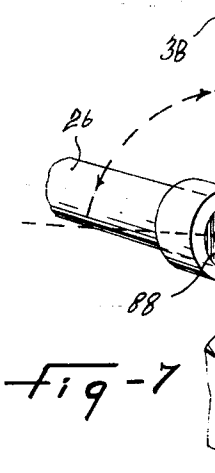
FIG. 7, which is shown on the sheet showing

In the preferred embodiment of the present invention, there are provided means for slightly raising the impression cylinder 24 so that the sheet being conveyed on the cylinder will contact the printing wheels 74 for adequate impression. Referring to FIG. 7, shaft 26 includes an eccentric portion 88 between sidewalls 16 and 18 so that, as shaft 26 is rotated in the sidewalls by actuation of lever portion 28 (as hereinbelow described), there is an upward force (see arrow 90 in FIG. 4) on the impression cylinder 24 causing the impression of a number on the sheet passing therebetween.

Figure 3:
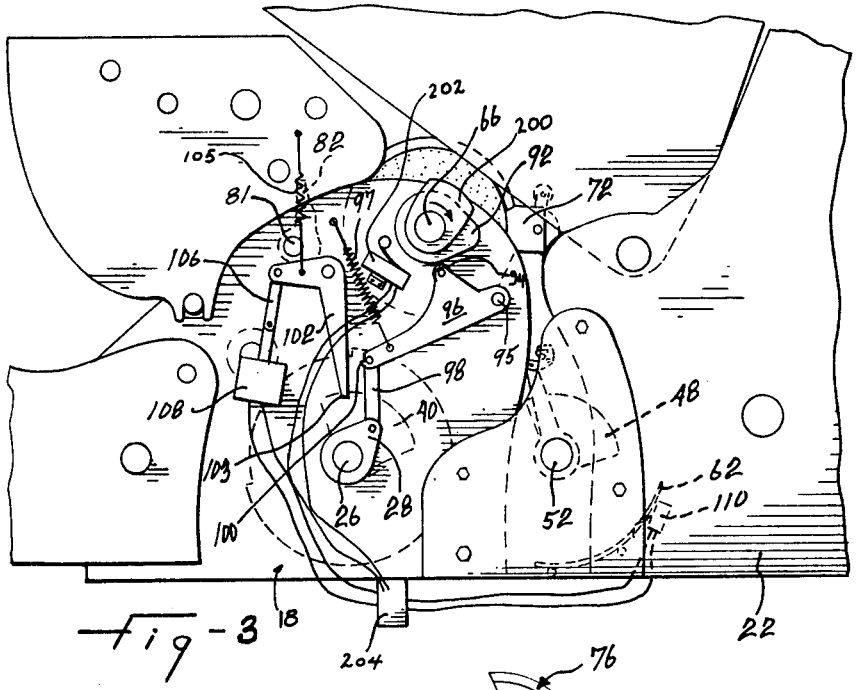
FIG. 3 is an elevational view showing the right-hand side of FIG. 1.
Figure 4:
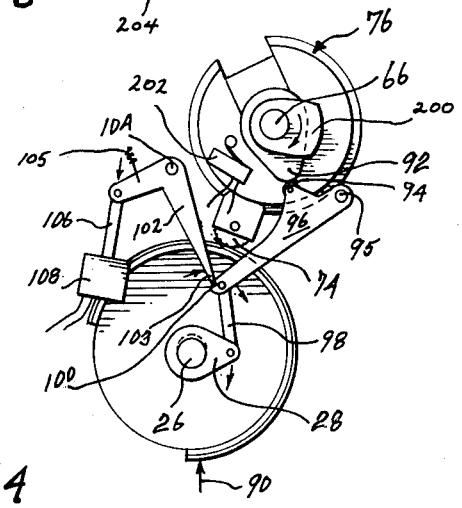
FIG. 4 is an illustrative view showing the cooperation of various parts of the attachment device during a numbering printing operation.

Referring to FIGS. 3 and 4, a cam member 92 is fixedly mounted to one end of shaft 66 and is adapted to contact the roller 94 of a lever 96 which is pivotably mounted at 95 to the attachment wall 18. A link member 98 connects lever 96 to part 28 on shaft 26. End 100 of lever 96 is shaped to receive for engagement therewith the extremity 103 of an angled lever arm 102 pivotably mounted at 104 to the attachment wall 18. The opposite end of lever arm 102 is pivotally connected to a rod member 106 which is actuatable by a solenoid 108 electrically connected to a switch 110 which is mounted to the arc segment 62 of the gripper bar device 50 and which is actuated by the passing of a sheet in segment 62. When solenoid 108 is de-energized, arm 102 returns to the position shown in FIG. 3 under the action of spring 105 which is connected at one end to sidewall 18. A spring 97, having one end connected to wall 18 and the other fixed to lever 96, maintains edges 100 and 103 in the contacting abutment shown in FIG. 4 (spring 97 having been omitted for clarity purposes).

Shaft 66 further includes, at one end thereof, a cam member 200 which is adapted to contact a switch 202 mounted to sidewall 18; this switch is electrically connected to a contact relay 204 and serves to remove the current in the solenoid 108 once extremities 100 and 103 have come in abutting engagement. This engagement is maintained by the action of spring 97 which is greater than that of spring 105.

Figure 5:
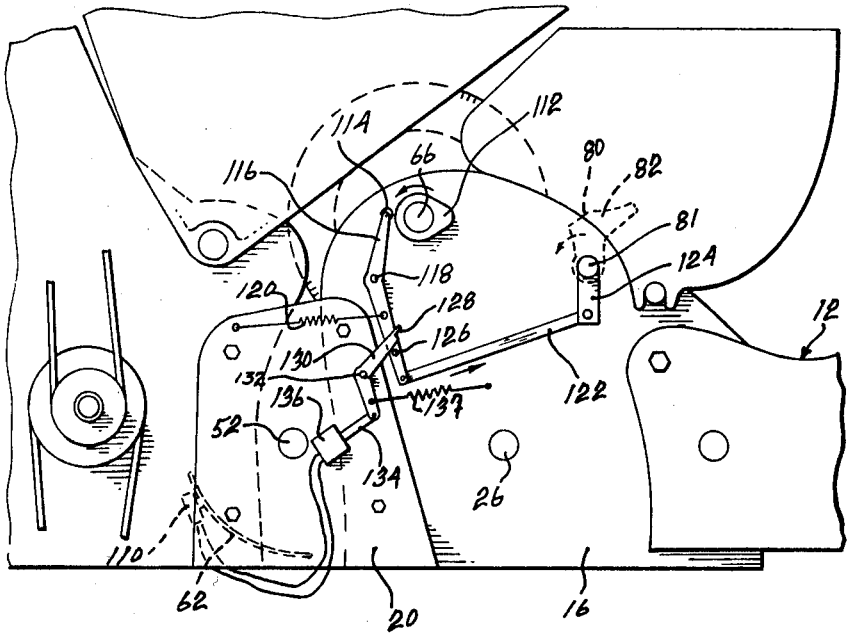
FIG. 5 is an elevational view showing the left-hand side of FIG. 1.
Figure 6:
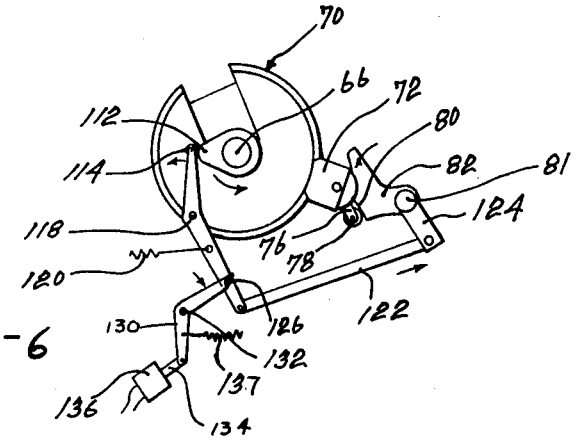
FIG. 6 is an illustrative view showing the cooperation of various parts of the attachment device for effecting a number change in the numbering device.

Referring to FIGS. 5 and 6, shaft 66 includes at the opposite end thereof a further cam member 112 which is adapted to contact roller 114 and to thereby pivot lever 116 about axis 118. One portion of lever 116 is downwardly urged by a spring 120 connected to the wall of the attachment. Lever 116 is operatively connected to shaft 81 via two link members 122 and 124, the latter being fixedly mounted to shaft 81 so that pivotal movement of link member 124 also causes the pivotal movement of lever member 82. Lever 116 includes a pin 126 which is adapted to be engaged by the extremity 128 of another lever 130 pivotally mounted at 132. The lower extremity of lever 130 is pivotally connected to a rod member 134 which is actuatable by a solenoid 136 electrically connected to switch 110 and relay 204 described above. When solenoid 136 is deenergized, arm 134 returns to the position shown in FIG. 5 under the action of a spring 137 secured, at one end thereof, to wall 16. Switch 202 also serves to cut the current in this solenoid 136 once extremity 128 and pin 126 have come in engagement as in FIG. 6; this engagement is maintained by the action of spring 120 which is greater than that of spring 137.

The operation of the numbering attachment will now be given. Sheets are delivered successively from the offset printing machine, each being conveyed on cylinder 10 and held by grippers 11 of similar construction and operation to that of grippers 32 of cylinder 24 (see FIG. 2). Each sheet is passed to the gripping fingers 42 of the gripper bar device 50 and then contacts switch 110. Referring to FIGS. 5 and 6, as soon as switch 110 is closed, solenoid 136 is energized causing the inward movement of rod 134 in the solenoid and the clockwise rotation of lever 130 about pivot 132 and against the action of spring 137; however, engagement of extremity 128 with stud 126 will occur only when cam 112 will have contacted roller 114 and caused the counter-clockwise rotation of lever 116 against the action of spring 120. As shown in FIG. 6, lever 82 is thus maintained in the position shown to cause the actuation of lever 76 when roller 78 follows surface 80 and to effect a number change.

Referring now to FIGS. 3 and 4, the actuation of switch 110 causes also the energizing of solenoid 108 and the counter-clockwise rotation of lever 102 against the action of spring 105; however, engagement of extremity 100 with end 103 will only occur once when cam 92 will have contacted roller 94 and caused the counter-clockwise rotation of lever 96 about point 95 and against the action of spring 97. When lever 96 rotates, arm 98 causes portion 28 of shaft 26 to rotate somewhat and, since shaft 26 has an eccentric portion 88, the impression cyclinder is slightly raised whereby printing wheels 74 will contact the passing sheet.

Cam member 200 is shaped so that it will contact switch 202 after the above-described engagements of FIGS. 4 and 6 will have been effected. The actuation of switch 202 causes the de-energization of solenoids 108 and 136. The disengagement of parts 100–103 and 126–128 is, however, prevented by the action of springs 97 and 120, respectively, whose action is greater than that of springs 105 and 137. Should there be a void in the successive feeding of sheets, switch 110 will not be actuated and solenoids 108 and 136 will not be energized. There will occur, at the instants shown in FIGS. 4 and 6, a disengagement of parts 100–103 and parts 126–128 due to springs 105 and 137, respectively, causing the return of levers 102 and 130 to the positions shown in FIGS. 3 and 5 respectively. At the instants shown in FIGS. 4 and 6, the action of springs 97 and 120 is opposed by the action of cams 92 and 112 on members 96 and 116, respectively. Hence, all moving parts being in the position shown in FIGS. 3 and 5, there will be no raising force on the impression cylinder 24 nor will lever 82 be in a position to cause a number change in housing 72.

Returning to FIG. 2, once a number change has been effected, the numbering wheels contact the rollers of the inking device 85 for ink transfer. Once the number has been imprinted on the sheet, the latter is then conveyed from grippers 32 to grippers 142 of the chain delivery attachment 12. A gear wheel 144 on this chain attachment is in meshing engagement with gear 48 of the impression cylinder 24.

Although the present invention has been described in relation to some specific forms, it will be evident to the man skilled in the art that it may be refined and modified in various ways. For example, there may be provided a sheet perforating device mounted on a shaft supported on the sidewalls of the attachment for scoring the passing sheets. It is therefore wished to have it understood that the present invention is not limited in interpretation except by the terms of the following claims.

What is claimed is:

1. An attachment device for use with an offset duplicating machine having, at the delivery end thereof, rotary cylinder means including circular gear means and sheet gripping means for conveying a sheet to said delivery end, said device being provided for imprinting consecutive code characters on successive sheets being delivered from said duplicating machine, comprising, in combination:

a frame consisting of laterally spaced sidewalls fixedly attached to said delivery end of said machine;

an impression cylinder rotatably mounted, at opposite ends thereof, to said sidewalls, said impression cylinder including circular gear means and sheet gripping means;

a gripper bar device rotatably mounted to said sidewalls and being disposed between said rotary cylinder means of said duplicating machine and said impression cylinder; said gripper bar device including circular gear means in meshing engagement with said circular gear means of said rotary cylinder means and with said circular gear means of said impression cylinder, said gripper bar device further including a series of sheet gripping elements for gripping a sheet received from said rotary cylinder means and for conveying said sheet to said sheet gripping means of said impression cylinder;

character printing means mounted to said sidewalls, including: a rotatable shaft, circular gear means on said shaft in meshing engagement with said circular gear means of said impression cylinder, and an actuable character containing device mounted on said shaft for rotation therewith and adapted to successively contact said sheets, when conveyed on said impression cylinder, for printing consecutive characters thereon;

character changing means, mounted to said sidewalls, including actuator means contacting said character containing device for consecutively changing characters for each successive sheet printing operation;

means associated with said impression cylinder for raising said impression cylinder to said character containing device for each successive sheet printing operation;

said impression cylinder including a shaft supported on said sidewalls and having an eccentric portion; and wherein said means associated with said impression cylinder includes lever means pivotally mounted to one of said sidewalls for actuating said eccentric portion and raising said impression cylinder for contacting engagement between said sheet thereon and said character containing device; and a cam mounted to one end of said rotatable shaft of said character printing means outside said one sidewall for contacting and actuating said lever means.

2. An attachment device as defined in claim 1, further comprising second lever means mounted on the opposite sidewall of said frame and a second cam mounted to the opposite end of said rotatable shaft of said character printing means for contacting and actuating said second lever means for operating said actuator means whereby consecutive characters may be successively provided on said character containing device.

3. An attachment device as defined in claim 2, further comprising electrically operated means for detecting passage of a sheet in said gripper bar device and for actuating said character changing means and said means associated with said impression cylinder for raising said impression cylinder.

4. An attachment device as defined in claim 3, wherein said electrically operated means comprises switch means located adjacent said gripper bar device, a first solenoid mounted to said one sidewall for engaging said lever means in response to a signal received from said switch means, and a second solenoid mounted to said opposite sidewall for engaging said second lever means in response to said signal received from said switch means.

5. An attachment device as defined in claim 4, further comprising a third cam mounted to said one end of said rotatable shaft of said character printing means, and a second switch means mounted to said one sidewall and electrically connected to said solenoids; said second cam being adapted to actuate said second switch means and to de-energize said solenoids after said first and second lever means have been engaged.

6. An attachment device for use with an offset duplicating machine having, at the delivery end thereof, rotary cylinder means including circular gear means and sheet gripping means for conveying a sheet to said delivery end, said device being provided for imprinting consecutive code characters on successive sheets being delivered from said duplicating machine, comprising, in combination a frame consisting of laterally spaced sidewalls fixedly attached to said delivery end of said machine;

an impression cylinder rotatably mounted, at opposite ends thereof, to said sidewalls, said impression cylinder including circular gear means and sheet gripping means;

a gripper bar device rotatably mounted to said sidewalls and being disposed between said rotary cylinder means of said duplicating machine and said impression cylinder; said gripper bar device including circular gear means in meshing engagement with said circular gear means of said rotary cylinder means and with said circular gear means of said impression cylinder, said gripper bar device further including a series of sheet gripping elements; the rotational trajectory defined by said gripping elements of said bar being contiguous to the rotational trajectory defined by said gripping means of said impression cylinder so that a sheet seized by said gripping elements of said bar is directly conveyed to said sheet gripping means of said impression cylinder; and character printing means mounted to said sidewalls, including: a rotatable shaft, circular gear means on said shaft in meshing engagement with said circular gear means of said impression cylinder, and an actuable character containing device mounted on said shaft for rotation therewith and adapted to successively contact said sheets, when conveyed on said impression cylinder, for printing consecutive characters thereon.

7. An attachment device as defined in claim 6, further comprising character changing means, mounted to said sidewalls, including actuator means contacting said character containing device for consecutively changing characters for each successive sheet printing operation.

8. An attachment device as defined in claim 7, further comprising means associated with said impression cylinder for raising said impression cylinder to said character containing device for each successive sheet printing operation.

9. An attachment device as defined in claim 8, wherein said impression cylinder includes a shaft supported on said sidewalls and having an eccentric portion; and wherein said means associated with said impression cylinder include lever means pivotally mounted to one of said sidewalls for actuating said eccentric portion and raising said impression cylinder for contacting engagement between said sheet thereon and said character containing device.

10. An attachment device as defined in claim 6, wherein said character printing means further includes an inking device mounted to said sidewalls and consisting of a pan and a series of printing rollers; at least one of said rollers being disposed adjacent the path of said character containing device to allow ink transfer from said roller to a facing character of said character containing device.

11. An attachment device as defined in claim 6, said character containing device including releaseable fastening means thereon securing said character containing device at various locations on said shaft thereby providing various printing positions on sheets.

12. An attachment device as defined in claim 6, wherein said sidewalls include, at the free end thereof adjacent said impression cylinder, means for mounting a chain delivery attachment thereto, said chain delivery attachment including gripper means whereby the sheet on said impression cylinder may be conveyed to said chain delivery attachment; said chain delivery attachment further including circular gear means in meshing engagement with said circular gear means of said impression cylinder.

* * * * *